United States Patent [19]

Ichikawa

[11] Patent Number: 4,636,355

[45] Date of Patent: Jan. 13, 1987

[54] METHOD FOR MANUFACTURE OF HIGHLY DUCTILE MATERIAL

[75] Inventor: Kiyoshi Ichikawa, Yatabemachi, Japan

[73] Assignees: Agency of Industrial Science & Technology; Ministry of International Trade & Industry, both of Tokyo, Japan

[21] Appl. No.: 797,905

[22] Filed: Nov. 14, 1985

[30] Foreign Application Priority Data

Nov. 14, 1984 [JP] Japan ..... 59-239978

[51] Int. Cl.[4] ..... C22C 1/00

[52] U.S. Cl. ..... 420/590; 75/63; 75/65 R; 420/902

[58] Field of Search ..... 420/590, 902; 75/63, 75/65 R

[56] References Cited

U.S. PATENT DOCUMENTS 3,948,650 4/1976 Flemings ..... 75/65 R 3,951,651 4/1976 Mehrabian ..... 75/65 R

*Primary Examiner*—Peter D. Rosenberg

*Attorney, Agent, or Firm*—Oblon, Fisher, Spivak, McClelland, & Maier

[57] ABSTRACT

A method for the manufacture of a highly ductile material comprises melting an alloy material in a crucible held under a vacuum, inserting a stirring bar in the molten alloy material in the crucible and rotating the stirring bar at a low speed, causing the stirring bar to be rotated at a high speed after the molten alloy material has reached the temperature for starting solidification, and continuing the high speed rotation of the stirring bar until immediately before completion of the solidification.

3 Claims, 7 Drawing Figures

METHOD FOR MANUFACTURE OF HIGHLY DUCTILE MATERIAL

FIELD OF THE INVENTION AND RELATED ART STATEMENT

This invention relates to a method for the manufacture of an alloy exhibiting a high ductility known as superplasticity.

Alloy materials exhibiting high ductility, i.e. superplasticity, at temperatures in the range of $\frac{1}{2}$ to $\frac{2}{3}$ of melting point (K) of the alloy material have so far been produced by the technique of powder metallurgy. Although a variety of such alloy materials have been realized, the technique of powder metallurgy entails a complicated process and requires facilities of a large scale. It is therefore expensive.

As means of ensuring a uniform alloy structure and decreasing the size of the alloy crystal grains, there have been widely adopted the mold-rotating scraper method which comprises rotating a mold thereby enabling a stationary bar to slide on the solidifying boundary surface of a molten material near the mold, crushing formed crystals, and reducing the size of crystal grains, the scraper-rotating solidification method which comprises fixing a mold in place and causing a rotary bar to slide on the solidifying boundary surface of a molten material near the mold thereby reducing the size of crystal grains, and the rheocasting method which comprises keeping a material in a solid-liquid coexisting state and rotating a stirring bar inserted at the center of the material thereby reducing the size of crystal grains.

In all of these conventional methods, however, since the material being rotated and stirred must be prevented from engulfing air therein, there is entailed the disadvantage that the rotational speed must be restrained below a prescribed level.

OBJECT AND SUMMARY OF THE INVENTION

An object of this invention is to provide a method which, by causing crystal grains of a material to be finely divided by a simple procedure, converts the material into a highly ductile material capable of readily manifesting superplasticity at elevated temperatures exceeding $\frac{1}{2}$ of the melting point of the material.

To attain the object described above, the method provided by this invention for the manufacture of a highly ductile material comprises melting an alloy material in a crucible disposed inside a vacuum container, then inserting a stirring bar into the crucible, rotating the stirring bar at a low speed while the molten alloy material is in the process of cooling, increasing the speed of rotation of the stirring bar after the molten alloy material has substantially reached the temperature for starting solidification, and continuing the high-speed rotation of the stirring bar until immediately before the temperature for completing solidification. As used in the specification, the term "low-speed rotation" means a rotation at a rate not exceeding 1,000 rpm, the term "high-speed rotation" means a rotation at a rate exceeding 1,000 rpm, and the term "superhigh-speed rotation" means a rotation at a rate exceeding 5,000 rpm.

As described above, this invention, by a simple procedure of only imparting a mechanical high-speed rotational stirring to an alloy material in a solid-liquid coexisting state, effects superfine division of crystal grains of the material and produces a highly ductile material capable of readily manifesting superplascticity at elevated temperatures exceeding $\frac{1}{2}$ of the melting point of the material.

The other objects and characteristic features of this invention will become apparent from the description given in further detail hereinbelow with reference to the accompanying drawings.

DESCRIPTION OF PREFERRED EMBODIMENTS

Figure 1:
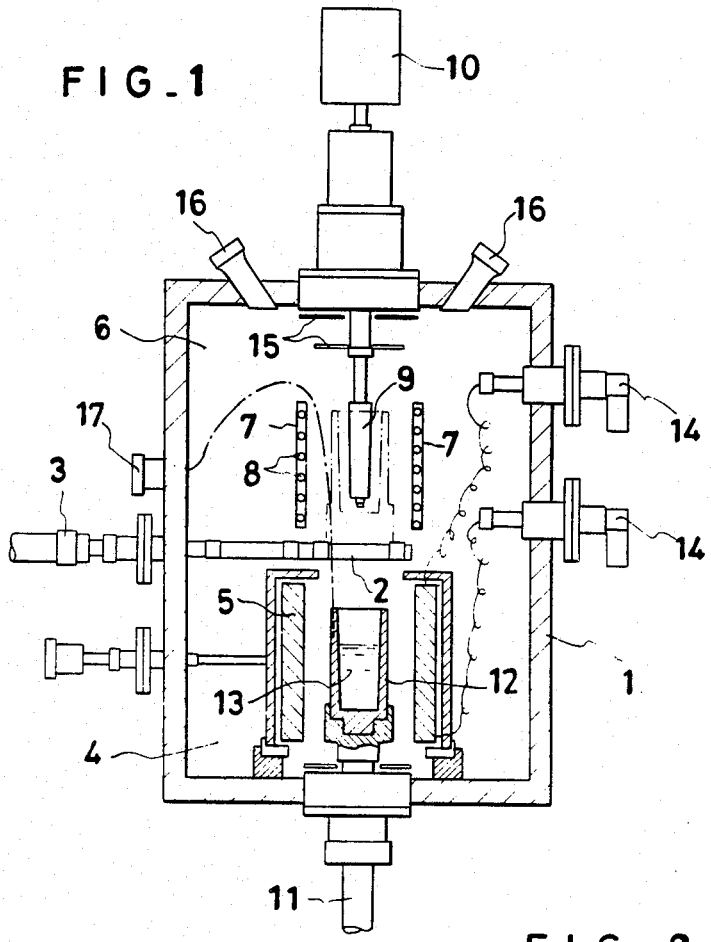
FIG. 1 is a cross sectional view illustrating one embodiment of an apparatus to be used in working the method of this invention for manufacture of a highly ductile material.

The method of this invention for the manufacture of a highly ductile material will be described in detail below. FIG. 1 represents a typical apparatus used advantageously in working the method of this invention. A chamber 1 provided in the front panel thereof with a door (not shown) for permitting insertion of a crucible into the chamber and inspection of the interior of the chamber constitutes a vacuum container. The interior of the chamber 1 is partitioned into upper cooling and lower heating rooms 6 and 4 by a shutter 2 made of molybdenum and adapted to be opened and closed by an air cylinder 3. Inside the lower heating room 4 is disposed a resistance heating furnace 5 of molybdenum in which a crucible 12 is supported on a support bar 11 so as to be movable up and down. The upper cooling room 6 has a water-cooling outer tube 7 provided with a cooling coil 8 disposed therein and a stirring bar 9 is suspended downwardly into the water-cooling outer tube 7. This stirring bar 9 is so constructed that it can be rotated at up to the superhigh speed of 10,000 rpm by a motor 10 provided at the upper end thereof. The motor 10 is provided on the rotary shaft thereof with a torque detector and a rotation detector (not shown) connected to a digital unit for displaying the rotational speed to be detected. In FIG. 1, 14, 14 stand for electrodes for the furnace, 15 for a reflecting plate, 16, 16 for inspection windows, and 17 for a temperature measuring port.

In the apparatus constructed as described above, a given alloy material is placed in the crucible 12 and then the air inside the chamber 1 is evacuated with a vacuum pump (not shown) and the shutter 2 over the heating furnace 5 is closed to heighten the efficiency of heating. Subsequently, the alloy material in the crucible 12 is fused by application of heat. After the alloy material 13 in the crucible 12 has been thoroughly fused, the shutter 2 over tne furnace is opened and the support bar 11 supporting tne crucible 12 by the bottom thereon is raised by an elevating mechanism until the crucible 12 is located inside the water-cooling outer tube 7. As a result, the stirring bar 9 is gradually inserted, with the forward end thereof in the lead, into the molten alloy material 13 in the crucible 12. While the alloy material in the crucible is in the process of cooling, the stirring bar 9 is rotated at a low speed. The rotational rate of the stirring bar is raised to the high speed after the alloy material has substantially reached the temperature for starting solidification. The rotational stirring at the high speed is continued until immediately before the temperature for completing solidification. As a result, there is created an alloy of finely divided crystal grains capable of acquiring superplasticity at elevated temperatures exceeding ½ of the melting point of the material.

For this invention to be effectively worked, the alloy material used therein must possess a solid-liquid coexisting temperature zone. Concrete examples of alloy materials answering this description include Al-Pb, Al-Si, Cu-Al, Cu-Si, Cu-Al-Fe, Cu-Zn, Zn-Al, Bi-Sn, Fe-Al, steel, and superalloys.

The temperature to which the alloy in the crucible is heated is only required to be high enough to permit thorough melting of the alloy. The temperature decreasing speed for cooling the molten alloy in the crucible inside the cooling room is desired to be not less than about 25° C./min. The reason for this high temperature decreasing speed is that the fineness of the dendritic crystals inherently formed by the alloy increases in proportion as the temperature decreasing speed increases.

While the molten alloy in the crucible is in the process of cooling, the stirring bar 9 is rotated at a low speed of not more than 1,000 rpm to ensure formation and uniformization of alloy structure. As soon as the molten alloy begins to solidify, the rotational speed of the stirring bar is increased to a high rate exceeding 2,000 rpm. This high-speed rotation is continued until immediately before completion of the solidification. This stirring by the high-speed rotation is aimed at crushing dendritic crystals formed in the alloy and producing fine primary solid particles. As mentioned above, the primary solid particles so formed are more liable to fine division of size and assumption of spherical shape in proportion as the stirring speed is increased.

Since the purpose of stirring resides in crushing the dendritic crystals, the stirring bar is desired to be in a shape capable of effectively stirring the whole of the molten alloy. In consideration of the possibility that the molten alloy will fly in all directions during its high-speed stirring and the molten alloy will offer growing resistance when it begins to solidify, the stirring bar should have a shape offering relatively insignificant resistance. As typical stirring bars satisfying both the requirements mentioned above, there may be cited those stirring bars which possess rectangular cross sections, tetrahedral cross sections, and such cross sections with rounded corners. These stirring bars are capable of producing thorough stirring effects. The materials of these stirring bars are required to possess a higher degree of hardness than the alloy being stirred.

As described above, the rotational speed of the stirring bar is increased to a high rate exceeding 2,000 rpm after the molten alloy material has reached the temperature for starting solidification. In consequence of this increase in the rotational speed of the stirring bar, an Al-Cu alloy has its ductility improved by more than 90% at temperatures near 500° C. or an Al-Pb alloy by at least 35% at 200° C. and by at least 47% at 300° C.

The alloy, which has undergone the aforementioned high-speed rotation continued until immediately before completion of the solidification, becomes a mass of alloy in the crucible due to its fluidity still remaining. The mass of alloy is then subjected to elongation treatment to have a prescribed shape. The shaped mass of alloy may be treated, as occasion demands, so as to exhibit its original properties. Thus, even superalloys can easily be formed into a desired shape.

As described in detail above, the method of this invention for the manufacture of a highly ductile material enables the produced material to acquire superplasticity owing to the formation of extremely fine crystal grains heretofore unattainable by the conventional casting method. Thus, this method enables a material of a high ductility not attainable in a conventionally cast material of an identical composition to be obtained inexpensively. The material of high ductility so produced, therefore, is expected to find extensive utility in applications to building panels, housings for office machines and vending machines, noise abating panels, automotive parts, and aircraft parts. Thus, this invention will contribute immensely to industry.

Now, this invention will be described below with reference to working examples. It should be noted that these working examples are purely illustrative, and not limitative in any sense, of the present invention.

EXAMPLE 1

In an apparatus constructed as illustrated in FIG. 1, a crucible of graphite 55 mm in inside diameter and 130 mm in depth was filled with about 0.5 kg of Al-Cu alloy. The heating room was evacuated to a vacuum degree of at least $1\times10^{-5}$ Torr, the shutter over the molybdenum resistance furnace was closed, and the crucible disposed inside the resistance furnace was heated at about 800° C. until the alloy was melted. After the melting of the alloy in the crucible was confirmed, the molten alloy was held at 827° C. for 30 minutes. Then, the shutter over the furnace was opened and the crucible was raised at a speed of 25 mm/sec with the elevating mechanism until a graphite stirring bar was inserted into the crucible inside a water-cooling outer tube and the leading end of the stirring bar reached a distance of 10 mm from the bottom wall of the crucible. At this time, the length of the stirring bar immersed in the molten alloy was about 100 mm.

Figure 2:
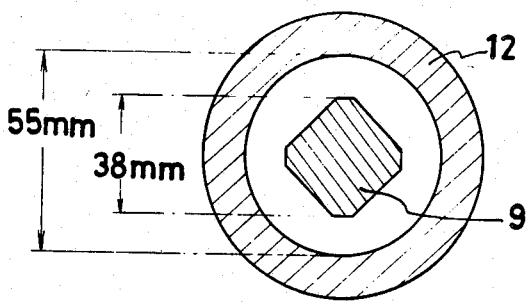
FIG. 2 is a plan view illustrating the cross-sectional relation between a crucible and a stirring bar in the apparatus of FIG. 1.

Then, flow of cold water through the cooling coil inside the water-cooling outer tube was started to effect cooling of the molten alloy at a rate of about 25° C./min while the stirring bar was kept rotated at a rate of 540 rpm. The stirring bar had a generally square cross section and tapered from 30 mm at the upper end to 25 mm at the lower end, with the four corners cut off as illustrated in FIG. 2.

An electronic automatic null-balancing recorder attached to the aforementioned apparatus was operated to record the changing cooling temperature in a continuous curve. At the time that the recorded curve indicated start of solidification of the molten alloy, the rotational speed of the stirring bar was raised to 2,000, 3,000 or 4,000 rpm in 10 seconds and held fixed at the rate thereafter. In this case, the rotational speed was increased at a fixed rate so as to prevent the molten alloy from being scattered in consequence of a sharp increase in the rotational stirring.

Thereafter, the rotational stirring was continued at the fixed rate indicated above until immediately before completion of the solidification was confirmed based on the cooling curve of the automatic null-balancing recorder and the torque value on the digital display device. Then, the crucible was lowered by about 200 mm with the crucible elevating mechanism to prevent the stirring bar from being used with the alloy under treatment.

The Al-Cu alloy used in this experiment was in three compositions, i.e. Al-10%Cu, Al-24%Cu, and Al-30%Cu. While the stirring bar was inserted into the crucible and rotated in the semi-solid alloy at a fixed rate of 2,000, 3,000 or 4,000 rpm, change in the torque generated on the stirring bar was recorded between the time the solidification of the molten alloy was started and the time the solidification was completed.

The results indicate that the magnitude of apparent torque tends to remain at a low level until the latter half of solidification because the primary solid particles formed by the crushing of dendritic crystals are more liable to lose in mutual connection and retain their individually suspended state in the remaining liquid phase generally in proportion as the rotational speed of the stirring bar is increased. This trend is particularly conspicuous in the Al-10%Cu alloy.

In the Al-24%Cu alloy, a similar trend was observed although the level of torque was fairly high. During the solidification of the Al-24%Cu alloy by the stirring at a rotational speed of 4,000 rpm, the magnitude of torque increased abruptly 70 seconds after the start of solidification. This sharp increase of the torque may be because the individual primary solid particles completely separated during the initial phase of solidification by the stirring at the high rotational speed were interconnected all at once because the ability of the primary solid particles to grow exceeded the ability of rotational stirring in consequence of the growth of the solid phase.

In the case of the Al-30%Cu alloy, the level of torque was still higher. In this case, however, since the period for the growth of primary solid particles was short and the amount of eutectic was large, the torque curves during the solidification by the rotational stirring at the two rates, 2,000 and 3,000 rpm, were too vague to be clearly discriminated from each other.

Figure 3:
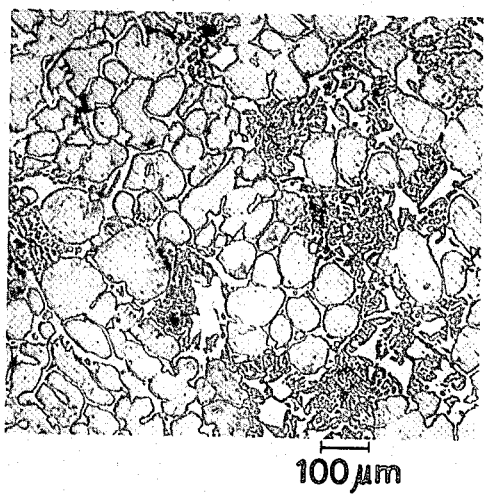
FIG. 3 is a photomicrograph of an Al-24%Cu alloy (2,000 rpm) obtained by the method of this invention.
Figure 4:
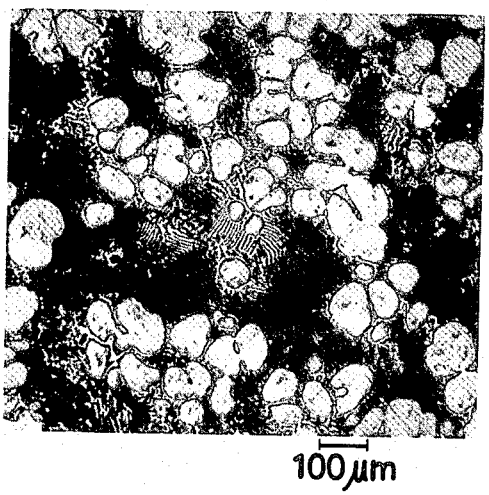
FIG. 4 is a photomicrograph of an Al-24%Cu alloy (4,000 rpm) obtained by the method of this invention.
Figure 5:
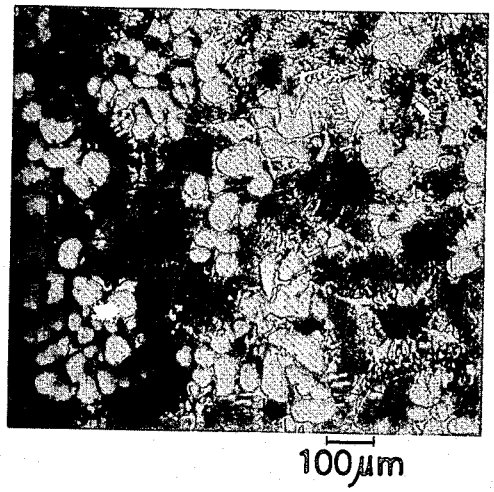
FIG. 5 is a photomicrograph of an Al-30%Cu alloy (2,000 rpm) obtained by the method of this invention.

Photomicrographs showing the microstructures of the Al-24%Cu alloy (2,000 rpm), Al-24%Cu alloy (4,000 rpm), and Al-30%Cu alloy (2,000 rpm) are given respectively in FIG. 3, FIG. 4, and FIG. 5.

It is noted from the micrographs that the primary solid particles formed when the dendritic crystals are fragmented on exposure to shearing force of the molten alloy tend to lose in diameter in proportion as the rotational speed of the stirring bar is increased.

The grain size of the primary solid particles was determined by processing the images in the photomicrographs of the alloys. The results were as shown in Table 1 below.

TABLE 1

| Rotational speed (rpm) | Grain size (μm) | | |
|---|---|---|---|
| | Al—10% Cu | Al—24% Cu | Al—30% Cu |
| 1,200 | — | 94 ± 34 | — |
| 2,000 | 101 ± 31 | 87 ± 28 | 55 ± 17 |
| 3,000 | 98 ± 34 | 75 ± 30 | 52 ± 21 |
| 4,000 | 90 ± 29 | 61 ± 32 | 46 ± 14 |

It is noted from the foregoing table that the decrease in diameter of the primary solid particles depends particularly on the increase in the Cu content of the alloy and on the increase in the rotational speed of the stirring bar. Further, the process of the dendritic crystals being fragmented by the intensive rotational stirring and the consequently formed primary solid particles being transformed from their irregular shape to a spherical shape along with the increase in the rotational speed is clearly noted in conjunction with the decreasing trend of the diameter of the primary solid particles.

Figure 6:
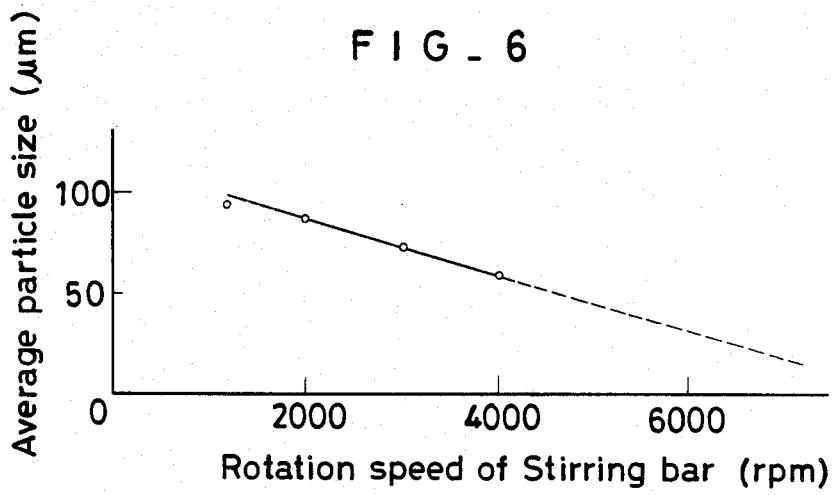
FIG. 6 is a graph showing the relation between the rotational speed of the stirring bar and the diameter of crystal grains, i.e. primary solid particles in an alloy obtained by the method of this invention.

The relation between the rotational speed of the stirring bar and the diameter of primary solid particles as observed in the Al-24%Cu alloy is shown in the graph of FIG. 6. From the preceding table, the trend of crystal grains toward fine division is conspicuous as evinced by the substantially linear decrease in the diameter of the primary solid particles in proportion to the increase in the rotational speed. It is further expected that the diameter of primary solid particles will decrease even below 10 μm when the rotational speed of the stirring bar rises to the superhigh level exceeding 7,000 rpm.

Figure 7:
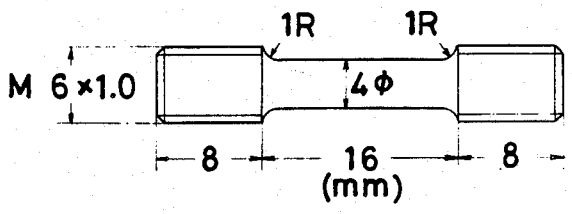
FIG. 7 is an explanatory diagram illustrating the size and shape of a test piece used in a tensile test.

From the alloy ingots described above, test pieces were prepared in the dimensions illustrated in FIG. 7. With a superplasticity testing machine, these test pieces were tested for elongation at elevated temperatures. This test was carried out under the conditions of 500° C. of temperature and $1.19\times10^{-3}\,s^{-1}$ of initial strain rate. The results are shown in Table 2. For comparison, an Al-24%Cu alloy ingot was produced without performing the aforementioned treatment by the high-speed stirring and a test piece was prepared from this alloy ingot and tested for elongation. The numerical values given in Table 2 were determined based on this test.

TABLE 2

| | 2,000 rpm | 4,000 rpm | Without treatment |
|---|---|---|---|
| Al—24% Cu | About 86% | About 91% | About 19% |
| Al—30% Cu | About 71% | — | About 14% |

EXAMPLE 2

Alloys were prepared by following the procedure of Example 1, except that an Al-24%Cu alloy and 0.04% of Ti and 0.005% of B added thereto were used as starting materials in one test run and an Al-24%Cu alloy and 0.5% of Ti and 0.1% of B added thereto were used as starting materials in another test run, with the rotational speed of the stirring bar fixed at 4,000 rpm.

The alloy ingots consequently produced were sectioned along the cores. The cross sections were observed under a microscope. It was found that the primary solid particles of the alloy having lower Ti and B contents had a diameter of 60±22 μm and that of the alloy having higher Ti and B contents had a diameter of 41±12 μm. Test pieces of these alloy ingots were tested for elongation by following the procedure of Example 1. The former alloy showed an elongation of about 92% and the latter alloy about 97%.

What is claimed is:

1. A method for the manufacture of a highly ductile material, which comprises melting an alloy material in a crucible held under a vacuum, inserting a stirring bar in the molten alloy material in said crucible and while cooling said molten alloy material rotating said stirring bar at a speed of less than 1,000 rpm, causing the stirring bar to be rotated at a high speed of more than 2,000 rpm after said molten alloy material has reached the temperature for starting solidification, and continuing said rotation of said stirring bar at more than 2,000 rpm until immediately before completion of the solidification.

2. A method according to claim 1, wherein said alloy material is an Al-Cu alloy.

3. A method according to claim 1, wherein said alloy material is an Al-Pb alloy.

* * * * *